US008056328B2

(12) United States Patent
Farrell et al.

(10) Patent No.: US 8,056,328 B2
(45) **Date of Patent: *Nov. 15, 2011**

(54) EXHAUST DIFFUSER FOR A TRUCK

(75) Inventors: Mark S. Farrell, Treichlers, PA (US); Ralph B. Pastore, New Tripoli, PA (US)

(73) Assignee: Mack Trucks, Inc., Greensboro, NC (US)

( * ) Notice: Subject to any disclaimer, the term of this patent is extended or adjusted under 35 U.S.C. 154(b) by 1011 days.

This patent is subject to a terminal disclaimer.

(21) Appl. No.: 11/999,877

(22) Filed: Dec. 7, 2007

(65) Prior Publication Data

US 2009/0145119 A1 Jun. 11, 2009

(51) Int. Cl.
*F01N 7/00* (2006.01)

(52) U.S. Cl. ..... 60/324; 60/317

(58) Field of Classification Search ..... 60/312, 60/324, 317

See application file for complete search history.

(56) References Cited

U.S. PATENT DOCUMENTS

| | | | | |
|---|---|---|---|---|
| 1,738,279 | A | 12/1929 | Barries | |
| 2,500,510 | A | 3/1950 | Barnes | |
| 3,683,624 | A | 8/1972 | Williams | |
| 4,143,731 | A | 3/1979 | Haustein | |
| 4,335,575 | A * | 6/1982 | Pagliuca | 60/319 |
| 4,665,691 | A | 5/1987 | Eller | |
| 4,970,859 | A * | 11/1990 | Yates et al. | 60/324 |
| 5,916,136 | A * | 6/1999 | Ettere | 60/316 |
| 7,051,524 | B1 * | 5/2006 | Kraft | 60/324 |
| 7,757,481 | B2 * | 7/2010 | Ryan et al. | 60/298 |

* cited by examiner

*Primary Examiner* — Thomas Denion
*Assistant Examiner* — Diem Tran
(74) *Attorney, Agent, or Firm* — Martin Farrell; Michael Pruden

(57) ABSTRACT

An apparatus for diluting and diffusing engine exhaust, includes a diffuser pipe horizontally oriented and having an inlet connection to receive exhaust gases from an engine and having an outlet defined as an elongated opening on an upper surface thereof, the inlet being disposed at about a longitudinal midpoint of the diffuser pipe, a deflector mounted in the diffuser pipe opposite the inlet to divide an entering exhaust gas flow toward opposite ends of the diffuser pipe, a baffle formed as an elongated plate having a multiplicity of holes mounted in the pipe between the inlet connection and the outlet and extending a length of the diffuser pipe, and, a dispersing grate formed as an elongated plate having a multiplicity of holes and being mounted above the outlet and spaced therefrom, the dispersing grate having a curvature about a longitudinal axis, and being mounted with a convex surface facing the outlet.

18 Claims, 3 Drawing Sheets

EXHAUST DIFFUSER FOR A TRUCK

FIELD OF THE INVENTION

The invention relates to devices mounted on truck exhaust systems to dilute and diffuse the exhaust gas as it is released from the truck.

BACKGROUND

More stringent emissions regulation on the amount of diesel particulate matter (DPM) and other gaseous constituents allowed in the exhaust gases of diesel engines has led to the use of exhaust aftertreatment devices such as diesel particulate filtration devices (DPF) and Diesel Oxidation Catalysts (DOC).

DPFs filter particulate matter from the exhaust gases to prevent it from exiting the tailpipe. After a period of operation, the collected particulate matter clogs the filter. The filter either needs to be replaced or removed for cleaning, which is not practical, or may be cleaned through a process known as regeneration. DPM is made up primarily of carbon, and is therefore combustible. Regeneration is a process where temperatures of the exhaust gases are made high enough to combust or oxidize the DPM within the filter. The regeneration process can cause the temperature of the exhaust gas exiting the diesel particulate filter to be well in excess of 600° C. By comparison, normal operating exhaust temperature for a diesel engine depends on the load and can range from about 100° C. at idle to about 500° C. at high load.

At highway speeds, high exhaust temperatures do not usually pose problems because the relatively high air speeds tend to disperse widely the heated gases. Exhausting the higher temperature gas stream can create difficulties when the vehicle is stationary or moving at low speed and is near combustible materials. For example, the stop and go movement of a trash collection truck on a street with overhanging trees could present difficulties. A truck typically has an exhaust stack pipe rising from the chassis adjacent to the truck cab. High temperature exhaust can produce a hot spot on the truck cab or trailer, or direct hot gases to a combustible substance, such as a building structure (for example, a loading dock or in a garage) or an overhanging tree.

It is desirable to provide an arrangement and a method for lowering the temperature of engine exhaust, particularly when the engine is operated for regeneration of exhaust aftertreatment devices.

In addition, in vocational trucks (dump trucks, trash hauling trucks, etc), the exhaust stack and the exhaust gases must not interfere with the operation of the body, lifting the dump body, for example.

SUMMARY OF THE INVENTION

According to a preferred embodiment of the invention suitable for vocational trucks such as dump trucks and trash collection trucks, a diluting and diffusing apparatus is mounted at the end of an exhaust stack. The diffuser is mounted downstream of the catalyst and diesel particulate filter (DPF) in the exhaust system. The diffuser allows exhaust gases to mix with ambient air and to disperse over a larger area than does a standard exhaust pipe, which helps avoid concentrations of hot gases.

An apparatus in accordance with an embodiment of the invention includes a diffuser pipe horizontally oriented and having an inlet connection to receive exhaust gases from an engine and having an outlet defined as an elongated opening on an upper surface thereof. According to a preferred embodiment, the inlet is disposed at about a longitudinal midpoint of the diffuser pipe and includes a deflector mounted in the diffuser pipe opposite the inlet to divide an entering exhaust gas flow toward opposite ends of the diffuser pipe. The diffuser may also include a baffle formed as an elongated plate having a multiplicity of holes mounted in the pipe between the inlet connection and the outlet and extending a length of the diffuser pipe. The baffle slows the gas flow to promote better distribution through the diffuser. The invention may also include a dispersing grate formed as an elongated plate having a multiplicity of holes and being mounted above the outlet and spaced therefrom, the dispersing grate having a curvature about a longitudinal axis, and being mounted with a convex surface facing the outlet. The dispersing grate disperses the gas flow exiting the diffuser outlet into the ambient air.

According to one variant of the invention, the diffuser pipe has two outlets, each formed as an elongated opening in the upper surface of the diffuser pipe and mutually spaced longitudinally.

According to another aspect of the invention, the apparatus includes an inlet conduit having a first end connectable to an outlet of a diesel particulate filter and a second end connected to the inlet of the diffuser pipe, the inlet conduit having two 180 bends.

According to yet another aspect of the invention, each of the multiplicity of holes in the dispersing grate is formed as a slotted hole, a long axis of the slotted hole oriented in a transverse direction of the dispersing grate.

According to yet another aspect of the invention, the apparatus includes an air guide to direct a flow of ambient air across the diffuser pipe and upward from the diffuser outlets and dispersing grate, the air guide including a curved wall mounted to surround a longitudinal periphery of the diffuser pipe. The curved wall extends from a lower side of the diffuser pipe upward and is spaced from the diffuser pipe to allow for air flow. A screen is mounted to the air guide on a front and top thereof to prevent external things, such as leaves and branches, from coming into contact with the diffuser pipe. The air guide may include solid side walls or screens mounted at opposite ends of the diffuser pipe.

BRIEF DESCRIPTION OF THE DRAWINGS

The invention will be better understood by reference to the following detailed description read in conjunction with the appended drawings, in which.

DETAILED DESCRIPTION

The invention relates to devices that are mounted on a truck exhaust system at the point where exhaust gas is released to the surrounding air. The devices of this invention dilute the exhaust gas with ambient air and diffuse the exhaust gas over a wider area than a typical exhaust stack pipe to prevent concentrations of hot gases and dissipate exhaust heat more quickly.

A diluting and diffusing apparatus in accordance with the invention has particular advantage for use with a vocational truck, for example, a trash collecting truck or a dump truck, and the description here is in connection with a vocational truck. However, it is to be understood that the description is for the purposes of illustrating and explaining the invention and the invention is not limited to a particular type of truck and may be installed on other types of trucks.

Figure 1:
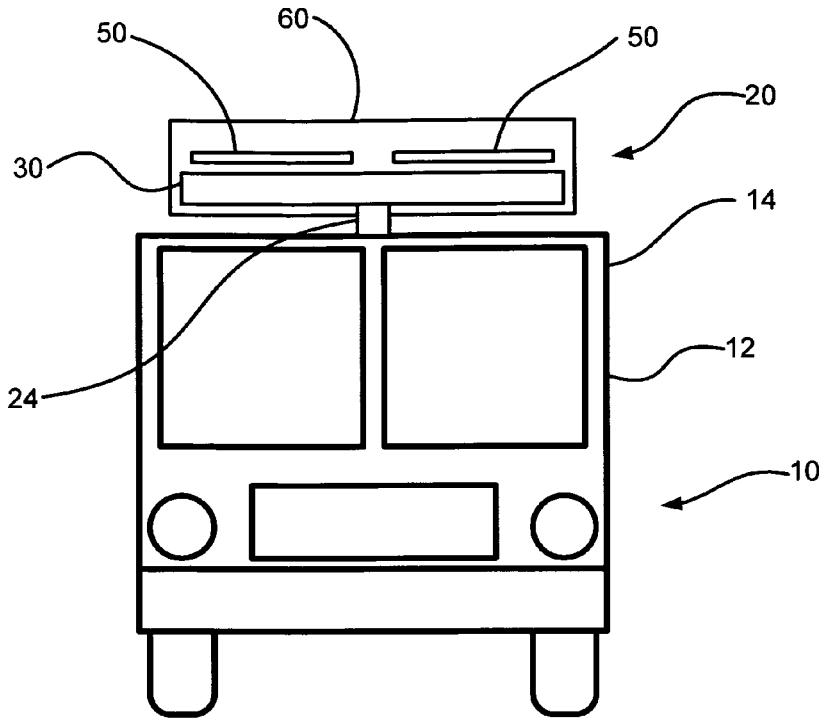
FIG. 1 illustrates a simplified front view of a truck with a diluting and diffusing apparatus in accordance with the invention mounted on the truck.
Figure 2:
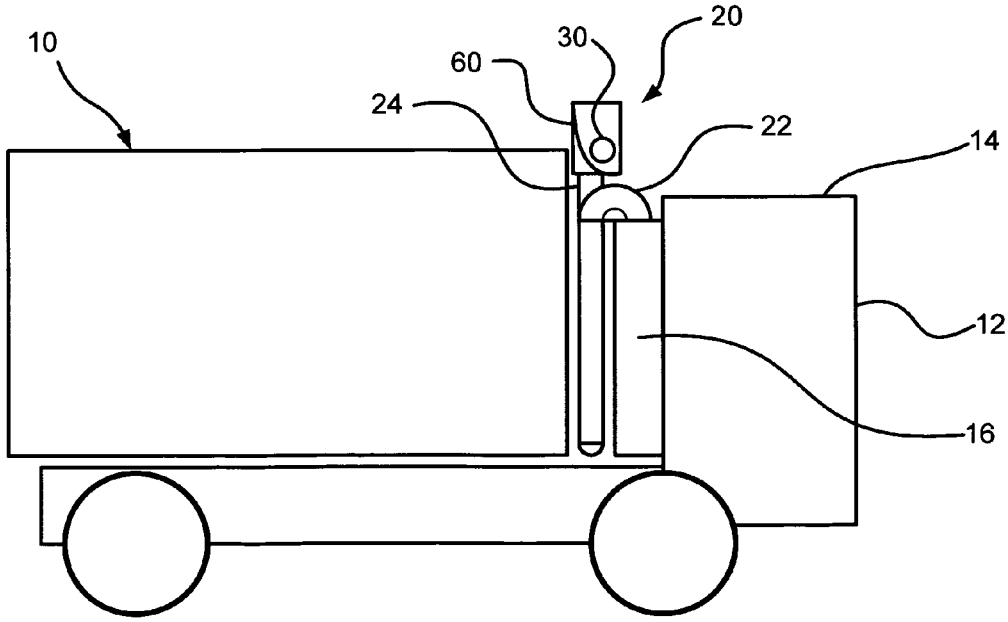
FIG. 2 illustrates, also in simplified form, a side view of the truck and apparatus of FIG. 1.

FIG. 1 shows a front schematic view of a truck 10 having an exhaust dilution and diffusing apparatus 20 in accordance with the invention. FIG. 2 is a side schematic view of the truck 10 of FIG. 1. The apparatus 20 is mounted behind the cab 12 and slightly above the top 14 of the cab to guide exhaust gas from the vehicle engine (not illustrated) away from the vehicle 10. The apparatus may be mounted to the truck by any convenient structure.

The apparatus 20 is connected to receive exhaust gas from the vehicle exhaust aftertreatment system, illustrated here as a diesel particulate filter or DPF 16. An inlet conduit 22 carries exhaust gas from the DPF 16 to an inlet 24 of the apparatus 20. The exhaust gas then enters a diffusing pipe 30, which is disposed transversely to the truck cab 12, and after diffusing in the diffusing pipe, exits from outlet openings 36 on an upper surface of the diffusing pipe (shown in greater detail in FIGS. 4 and 5).

Exhaust gas exiting the diffusing pipe 30 is dispersed by a dispersing grate 50 mounted above the outlet openings of the diffusing pipe. The dispersing grate 50 is not illustrated in FIG. 2 to preserve the clarity of that figure.

An air guide 60 serves as a shield around the diffusing pipe 30 to prevent contact with external objects, such as leaves and tree branches, and to guide ambient air across the diffusing pipe 30 when the vehicle is moving forward. Ambient air moving across the diffusing pipe 30 helps cool the surface of the pipe, which has been heated by the diffusing exhaust gas. Ambient air also mixes with the exhaust gas exiting the diffusing pipe 30 and being dispersed by the dispersing grate 50 to help dilute and cool the exhaust gas.

Figure 3:
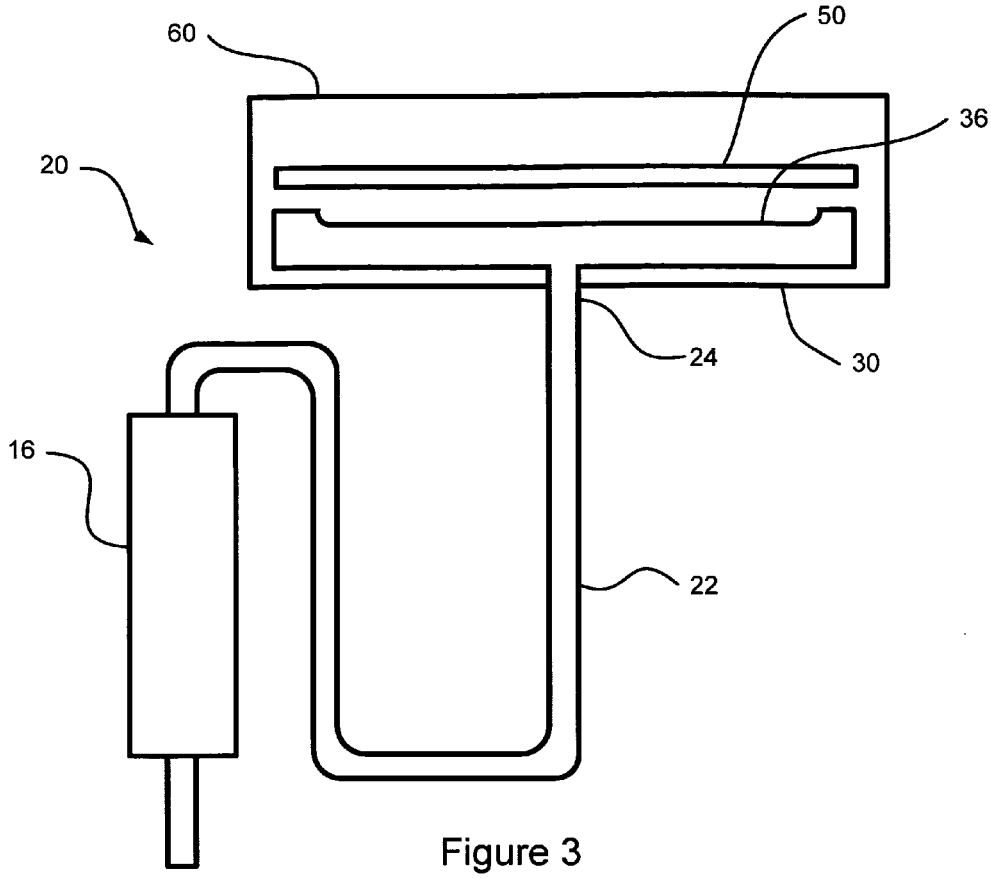
FIG. 3 is a schematic view of the apparatus of the invention.

A schematic layout of the apparatus of the invention is illustrated in FIG. 3. As described above, exhaust gas exits the DPF 16, which, if a regeneration is active, will be at elevated temperatures. The exhaust gas is carried by the inlet conduit 22 to the inlet 24 of the diffusing pipe 30. The inlet conduit 22 takes an indirect path to the inlet 24, rather than a direct, shortest path, so that some heat from the exhaust may be radiated and conducted from the surface of the inlet conduit 22 to the atmosphere. In the illustrated embodiment, the inlet conduit 22 forms a serpentine path having two 180° bends, although other courses are possible.

Figure 4:
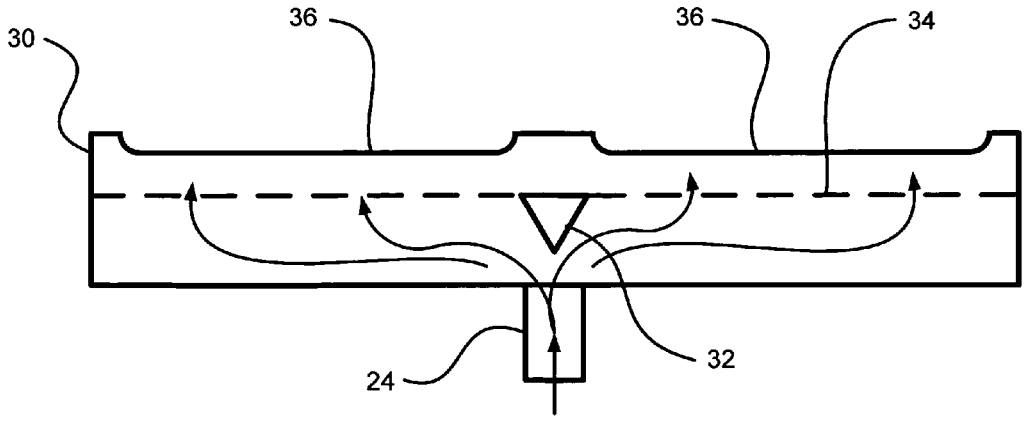
FIG. 4 is a front sectional view of a diffuser pipe.
Figure 5:
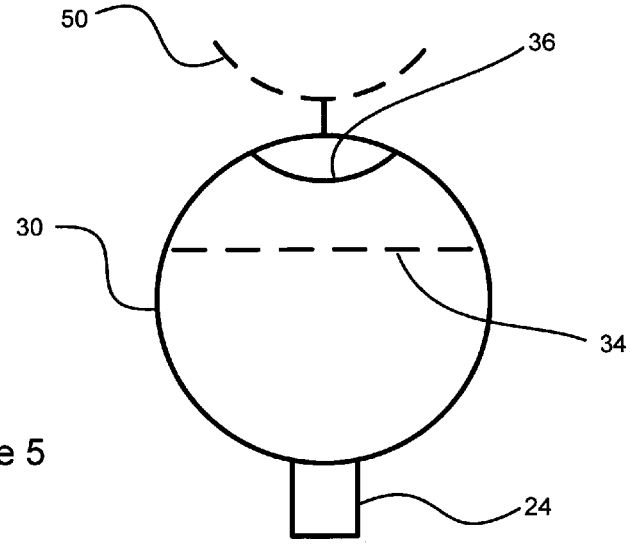
FIG. 5 is a side sectioned view of the diffuser pipe of FIG. 4 and including a dispersing grate mounted above the diffuser pipe; and, FIG. 6 is a perspective view of an air guide of the diluting and diffusing apparatus.

Reference is now made also to FIG. 4 which shows a front schematic view of the diffusing pipe 30 and FIG. 5 which shows an end view of the diffusing pipe. The arrows in FIG. 4 give an indication of the flow path of exhaust gas through the diffusing pipe 30. In a preferred embodiment, the inlet 24 is positioned on a lower portion and at about a longitudinal midpoint of the diffusing pipe 30. The diffusing pipe 30 includes a deflector 32 mounted in the pipe and opposite the inlet 24. The deflector 32 directs and divides the entering flow into longitudinally moving flows toward the opposite ends of the diffusing pipe. The deflector 32 may, for example, be formed as a conical surface, a wedge, or a simple plate. A baffle 34 is disposed in the diffusing pipe 30 and longitudinally divides the interior space. The baffle 34 is preferably formed as a perforated sheet, and may include circular or non-circular holes, as is convenient and appropriate. The baffle 34 slows the exhaust gas flow and helps distribute it through the length of the diffusing pipe. The size and arrangement of the holes may be selected to achieve a desired flow. The slowed exhaust gas flow has a dwell time in the diffusing pipe 30 that allows some heat energy to be absorbed by the pipe walls, and some of the energy can then be transferred by conduction to ambient air passing across the diffusing pipe.

The diffusing pipe 30 also has at least one outlet 36 formed as a slot on an upper portion of the pipe. In FIG. 3 a single slot is shown, and in FIG. 4 two outlet slots 36 are shown. Exhaust gas diffused in the diffusing pipe 30 passes through the apertured baffle 34 and exits the diffusing pipe 30 through the outlet or outlets 36.

A dispersing grate 50 is mounted spaced above the outlet openings 36 in the diffusing pipe 30. The dispersing grate 50 is formed as a perforated sheet having a multiplicity of holes, which may be circular, slotted, or another shape. The dispersing grate 50 slows and disperses or spreads the exiting exhaust gas flow over an area wider than the outlet opening to help mix the exhaust gas flow with ambient air. According to a preferred embodiment, the dispersing grate 50 is curved about a longitudinal axis, with a concave surface facing the outlet openings 36, so that exhaust gas can flow around and through the dispersing grate in an expanding flow. The dispersing grate 50 has a width, perpendicular to the longitudinal direction that is greater than a width of the outlet openings 36, which helps disperse the exhaust gas to the surrounding environment.

Figure 6:
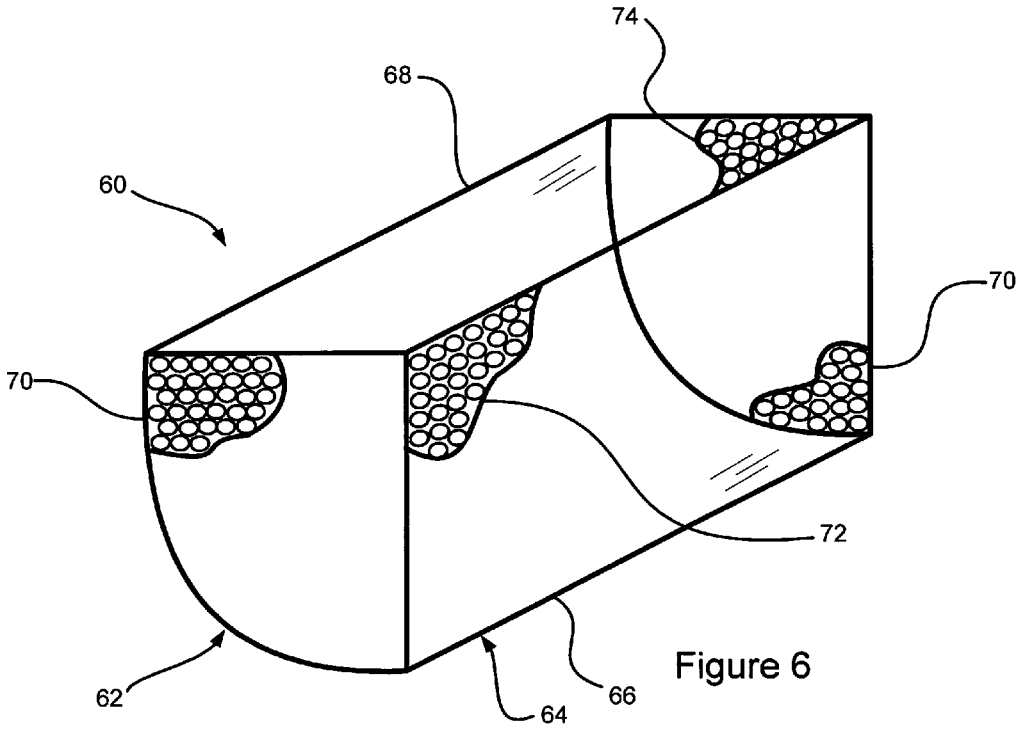

FIG. 6 illustrates an air guide 60, also seen in FIGS. 1, 2, and 3. The air guide 60 guides a flow of ambient air across the diffusing pipe 30 (not shown in FIG. 6) and forms a shield, which has a function to prevent external objects, such as leaves and tree branches, from contacting the diffusing pipe. Another function of the air guide 60 is to guide ambient air across the diffusing pipe.

The air guide 60 includes a curved wall 62, formed as a solid sheet, that surrounds a bottom portion of the diffusing pipe 30 (see FIG. 2) and extends behind and upward of the diffusing pipe outlets 36 and the dispersing grate 50. A lower portion 64 of the curved wall 62 has a horizontal front edge 66 positioned below the diffusing pipe 30. The lower portion 64 is shaped with a tighter curvature to create an entry scoop for ambient air that directs a flow of ambient air, usually ambient air movement generated by the moving vehicle, across the diffusing pipe 30 and then upward. The upper portion of the curved wall 68 is vertically oriented at its termination to direct ambient air and exhaust gas exiting the diffusing pipe 30 upward away from the vehicle. The ambient air flow, as mentioned, helps cool the diffusing pipe 30 through conductive heat transfer. The curved wall 62 also acts as a heat shield for part of the truck body, as may be understood from FIG. 2, the curved wall being between the diffusing pipe 30 and truck body. The curved wall 62 may be formed of sheet metal, for example, steel. Stainless steel may be used so that corrosion may be avoided.

The air guide 60 also includes side walls 70 located at opposite longitudinal ends of the curved wall 62 to enclose a space around the diffusing pipe 30, and prevent unwanted contact with the diffusing pipe. Preferably, as shown in section in FIG. 6, the side walls 70 are formed as screens, which can be of expanded metal, mesh material, or any other apertured, open material. The screen side walls allow for the flow of ambient air into and out of the air guide 60. Alternatively, the side walls 70 may be formed of sheet metal, for example, steel or stainless steel sheet.

A front wall 72 (shown in section) extends vertically upward from the front edge 66 of the curved wall 62 and is attached to front edges of the side walls 70. A top wall 74 (shown in section) covers a horizontal area defined by upper edges of the side walls 70 and an upper edge of the front wall 72. The front wall 72 and top wall 74 may be formed as mesh or screen walls, for example, from expanded metal, to allow for air flow and prevent unwanted contact of the diffusing pipe 30 with external objects.

The invention has been described in terms of preferred embodiments and structure; however those skilled in the art will understand that substitutions and variations may be made without departing from the scope of the invention as defined in the appended claims.

What is claimed is:

1. An apparatus for diluting and diffusing engine exhaust, comprising:

a diffuser pipe horizontally oriented and having an inlet connection to receive exhaust gases from an engine and having an outlet defined as at least one elongated opening on an upper surface thereof;

a baffle formed as an elongated plate having a multiplicity of holes mounted in the pipe between the inlet connection and the outlet and extending a length of the diffuser pipe; and, a dispersing grate formed as an elongated plate having a multiplicity of holes and being mounted above the outlet and spaced therefrom.

2. The apparatus of claim 1, wherein the outlet comprises two elongated openings formed in the upper surface of the diffuser pipe and mutually spaced longitudinally.

3. The apparatus of claim 1, further comprising an inlet conduit having a first end connectable to an outlet of a diesel particulate filter and a second end connected to the inlet of the diffuser pipe, the inlet conduit having two 180 bends.

4. The apparatus of claim 1, wherein the inlet is disposed at about a longitudinal midpoint of the diffuser pipe and further comprising a deflector mounted in the diffuser pipe opposite the inlet to divide an entering exhaust gas flow toward opposite ends of the diffuser pipe.

5. The apparatus of claim 1, wherein the dispersing grate has a curvature about a longitudinal axis, being mounted with a convex surface facing the outlet.

6. The apparatus of claim 5, wherein each of the multiplicity of holes in the dispersing grate is formed as a slotted hole, a long axis of the slotted hole oriented in a transverse direction of the dispersing grate.

7. The apparatus of claim 1, further comprising an air guide including a curved wall mounted to surround a portion of a longitudinal periphery of the diffuser pipe, the curved wall extending horizontally on a lower side of the diffuser pipe and then vertically upward and being spaced from the diffuser pipe to provide a gap to receive an air flow and direct the air flow across the diffuser pipe and upward therefrom.

8. The apparatus of claim 7, further comprising a screen mounted to the air guide on a front and top thereof.

9. The apparatus of claim 7, further comprising side walls mounted to the air guide and spaced from opposite ends of the diffuser pipe.

10. The apparatus of claim 9, wherein the side walls are formed as screens.

11. An apparatus for diluting and diffusing engine exhaust, comprising:

a diffuser pipe horizontally oriented and having an inlet being disposed at about a longitudinal midpoint of the diffuser pipe to receive exhaust gases from an engine and having an outlet defined as at least one elongated opening on an upper surface thereof;

a deflector mounted in the diffuser pipe opposite the inlet to divide an entering exhaust gas flow toward opposite ends of the diffuser pipe;

a baffle formed as an elongated plate having a multiplicity of holes mounted in the pipe between the inlet connection and the outlet and extending a length of the diffuser pipe; and, a dispersing grate formed as an elongated plate having a multiplicity of holes and being mounted above the outlet and spaced therefrom, the dispersing grate having a curvature about a longitudinal axis, and being mounted with a convex surface facing the outlet.

12. The apparatus of claim 11, wherein the outlet comprises two elongated openings formed in the upper surface of the diffuser pipe and mutually spaced longitudinally.

13. The apparatus of claim 11, further comprising an inlet conduit having a first end connectable to an outlet of a diesel particulate filter and a second end connected to the inlet of the diffuser pipe, the inlet conduit having two 180 bends.

14. The apparatus of claim 11, further comprising an air guide including a curved wall mounted to surround a portion of a longitudinal periphery of the diffuser pipe, the curved wall extending horizontally on a lower side of the diffuser pipe and then vertically upward and being spaced from the diffuser pipe to allow for air flow across the diffuser pipe.

15. The apparatus of claim 14, further comprising a screen mounted to the air guide on a front and top thereof.

16. The apparatus of claim 14, further comprising side walls mounted to the air guide and spaced from opposite ends of the diffuser pipe.

17. The apparatus of claim 16, wherein the side walls are formed as screens.

18. An apparatus for diluting and diffusing engine exhaust, comprising:

a diffuser pipe horizontally oriented and having an inlet being disposed at about a longitudinal midpoint of the diffuser pipe to receive exhaust gases from an engine and having an outlet defined as at least one elongated opening on an upper surface thereof;

a deflector mounted in the diffuser pipe opposite the inlet to divide an entering exhaust gas flow toward opposite ends of the diffuser pipe; and, a baffle formed as an elongated plate having a multiplicity of holes mounted in the pipe between the inlet connection and the outlet and extending a length of the diffuser pipe.

* * * * *